United States Patent [19]

Matthies

[11] 4,337,450

[45] Jun. 29, 1982

[54] REMOTE CONTROL ELECTRO-THERMAL ACTUATOR SWITCH

[75] Inventor: Alan A. Matthies, Milwaukee, Wis.

[73] Assignee: Eaton Corporation, Cleveland, Ohio

[21] Appl. No.: 157,698

[22] Filed: Jun. 9, 1980

[51] Int. Cl.[3] ..... H01H 71/16

[52] U.S. Cl. ..... 337/66; 337/70; 337/102

[58] Field of Search ..... 337/66, 70, 71, 74, 337/75, 77, 102–107; 335/74

[56] References Cited

U.S. PATENT DOCUMENTS

| | | | |
|---|---|---|---|
| 3,562,689 | 2/1971 | Bar | 337/77 |
| 3,706,057 | 12/1972 | Ellenberger | 337/66 |
| 3,932,829 | 1/1976 | Ellenberger | 337/77 |
| 4,167,716 | 9/1979 | Horn | 335/14 |

*Primary Examiner*—Harold Broome

*Attorney, Agent, or Firm*—C. H. Grace; L. G. Vande Zande

[57] ABSTRACT

An electric switch having an actuator (24) normally manually operable to close and open a load circuit is provided with an electro-thermal device (42) of the coil (46) heated bimetal (43) type connected to external terminals (16, 17) adapted to be energized by a remote switch and power source to actuate the manual actuator (24) back to its open position.

4 Claims, 6 Drawing Figures

REMOTE CONTROL ELECTRO-THERMAL ACTUATOR SWITCH

BACKGROUND OF THE INVENTION

Electro-thermal actuator switches have been known heretofore. They have been commonly of the circuit breaker type wherein the contacts are manually closed and latched and the latch is tripped to open the contacts in response to an abnormal current flowing in the circuit closed by such contacts to protect a branch circuit or the like from excessive currents. However, such breakers are normally manually actuated only from off to on and are not normally adapted to serve as switches for closing and opening a load circuit but rather as protective devices on over-current.

Electro-thermal delayed action switches have also been known wherein a delayed-action thermal circuit is closed locally simultaneously with actuation of the switch to closed position, and after a time interval the thermal element trips a latch to release the switch to open position.

Thermal relays have also been known wherein separate heaters controlled by a pair of auxiliary contacts control a bimetal to close and open a switch.

While these prior devices have been useful for their intended purposes, this invention relates to improvements thereover.

SUMMARY OF THE INVENTION

An object of the invention is to provide an improved remote control electro-thermal actuator switch.

A more specific object of the invention is to provide the combination of a manual switch that is normally actuated to close and open a load circuit and a remote control mechanism for actuating the switch to open position or to an alternate position.

Another specific object of the invention is to provide a remote thermal actuator switch that is simple in construction and effective in operation.

Another specific object of the invention is to provide a manually-operable on-off switch with a remote control means for moving the manual actuator to off or alternate position.

Other objects and advantages of the invention will hereinafter appear.

BRIEF DESCRIPTION OF THE DRAWINGS

FIG. 3*a* is a top view of the electro-thermal unit removed from the switch base;

DESCRIPTION OF THE PREFERRED EMBODIMENT

Figure 1:
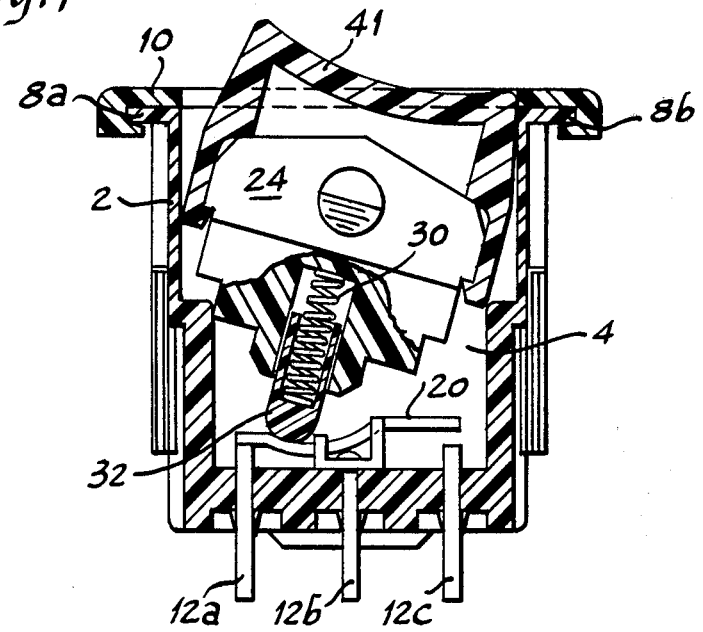
FIG. 1 is an enlarged vertical cross-sectional view of the remote control electro-thermal actuator switch taken substantially along line 1—1 of FIG. 3 to show the contacts and actuator of one pole of the two-pole double-throw switch.
Figure 2:
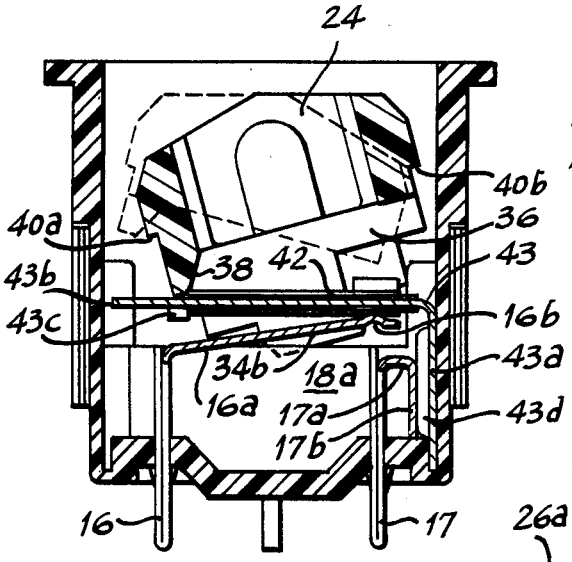
FIG. 2 is a vertical cross-sectional view taken substantially along line 2—2 of FIG. 3 to show the electro-thermal actuator of the switch of FIG. 1.
Figure 3:
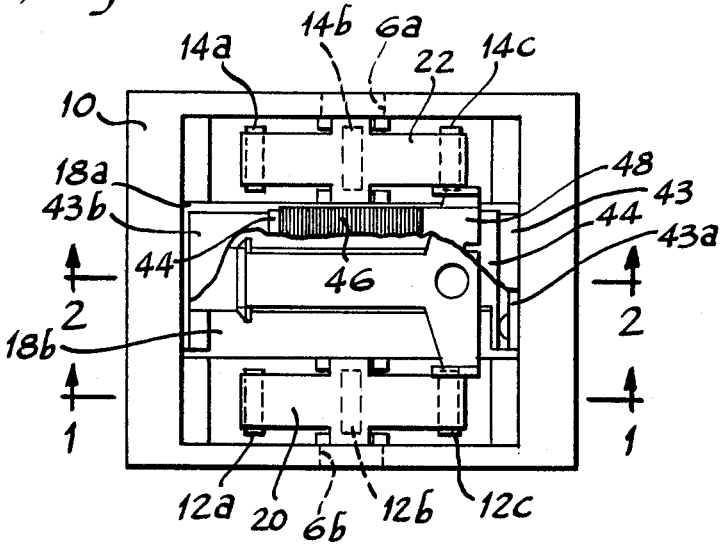
FIG. 3 is a top view of the switch of FIGS. 1 and 2 with the actuator and manual lever removed and the electro-thermal element partly broken away to show the terminals for the electro-thermal actuator.

Referring to FIGS. 1 and 2, there is shown a remote control electro-thermal actuator switch constructed in accordance with the invention. As shown therein, the switch is provided with a generally rectangular base 2 of molded insulating material having an open-top compartment 4 therein for the switch mechanism. A pair of aligned round holes 6*a–b* shown by dotted lines in FIG. 3 extend through opposite sides of the base for accommodating trunnions to pivotally support the switch actuator hereinafter described. Left and right lateral flanges 8*a* and 8*b* at the top of the base retain a snap-on bezel 10 that extends around and overlies the upper edge of the base as shown in FIGS. 1 and 3. This base is provided with two sets of three slots each through the bottom of the base through which the stationary contact terminals 12*a–c* and 14*a–c* of the two poles of the switch extend as shown in FIGS. 1 and 3, these sets of slots being near the opposite sides of the base. At the center of the base, two slots extend through the bottom of the base through which terminal pair 16 and 17 of the electro-thermal actuator extend as shown in FIG. 2, these terminals being separated from the two sets of stationary contact terminals by a pair of walls 18*a–b* that rise up from the bottom of the base and divide the lower portion of the base into three compartments as shown in FIG. 3 to separate and insulate the sets of contact terminals from the center terminal pair. A pair of contactors 20 and 22, one for each pole of the switch, are supported by their lateral wings on the cradle of the central contact terminal of each set thereof as shown in FIGS. 1 and 3 and may be rocked therefrom into engagement with either spaced stationary contact such as 12*a* or 12*c* in the case of contactor 20.

Figure 4:
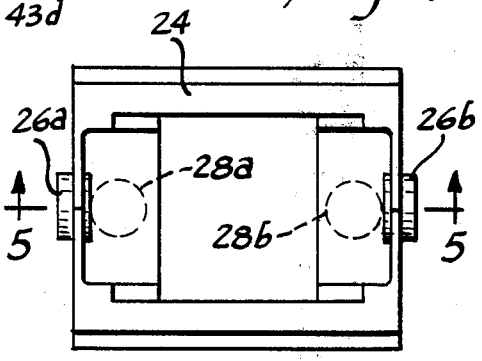
FIG. 4 is a top view of the actuator of the switch of FIGS. 1–3 showing the trunnions whereby this actuator is pivotally supported in the switch housing.
Figure 5:
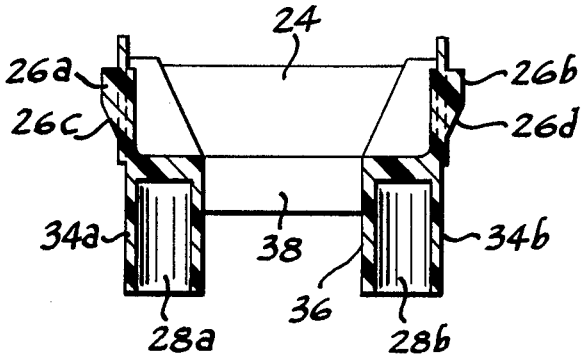
FIG. 5 is a cross-sectional view taken substantially along line 5—5 of FIG. 4 to show the blind holes for the plungers and their bias springs, and the beveled trunnions.

Actuator 24 is a molded member having a pair of oppositely directed trunnions 26*a* and 26*b* with their lower sides 26*c* and 26*d* beveled as shown in FIG. 5 so that the actuator may be pressed down into the base and the trunnions will snap into holes 6*a–b* of the base for limited pivotal movement within the base. As shown in FIGS. 4 and 5, this actuator has thin portions about these trunnions which in association with the thin wall portions of the base provide resiliency to allow the actuator to be snapped into the base. This actuator is provided with a pair of blind holes 28*a* and 28*b* as shown in FIGS. 4 and 5 extending up from opposite sides thereof for accommodating bias springs and plungers that resiliently slide along contactors 20 and 22 to actuate the same, one bias spring 30 and plunger 32 being shown in FIG. 1. As shown in FIG. 5, these blind holes are in spaced leg portions 34*a* and 34*b* of the actuator providing a large slot 36 therebetween affording clearance for the electro-thermal mechanism hereinafter described. The side of this slot 36 which goes down when the switch is turned on has a short depending skirt 38 as shown in FIGS. 2 and 5 which is engaged by the electro-thermal element to actuate the switch to its off or alternate position. This actuator is also provided with undercut portions 40*a* and 40*b* extending horizontally across opposite external walls thereof as shown in FIG. 2 for receiving a snap-in operating lever 41 as shown in FIG. 1.

The electro-thermal mechanism consists of an electro-thermal unit 42 and two terminals 16 and 17 for conducting remotely controlled electric current thereto. As shown in FIG. 2, electro-thermal unit 42 comprises an L-shaped bimetal member 43 having its shorter angular portion 43*a* pressed down into a groove in the bottom of the base at one side thereof so that its longer angular portion 43*b* extends horizontally across the base through slot 36 of the actuator. An electrically insulating sheet or tape 44 with adhesive backing surrounds this horizontal part of the bimetal throughout a large part of its length as shown in FIGS. 3 and 3*a* and an electrical heater coil 46 is wound on this insulated portion, leaving space at one end of this insulating tape for a terminal strap 48, this being the end of the tape nearest the right-angle bend in the bimetal element. As shown in FIGS. 3 and 3*a*, a pre-formed U-shaped terminal strap 48 is placed around this end of the insulating tape, one end of the coil wire is wrapped around in the notches at one end thereof, and the ends of this strap are then squeezed down tight so that the terminal strap surrounds and grips the bimetal assembly. The other end of this coil is connected to the bimetal by wrapping the other end of the coil wire around a short tongue 43*c* sheared and bent downwardly from the bimetal adjacent the corresponding end of the heater coil as shown in FIG. 2. As a result, one end of the coil is electrically connected to terminal strap 48 and the other end of the coil is connected to the bimetal so that terminals 16 and 17 connected thereto, respectively, will afford electrical energization of both the bimetal and the heater coil in series.

For the above purpose, mounting portion 43*a* of the bimetal has two spaced vertical ridges 43*d* therein for making pressure contact with terminal 17. As shown in FIGS. 2 and 3, terminal 17 is formed with a first 90 degree bend and a second bend 17*a* less than 90 degrees so that when its terminal end is inserted through the hole in the base, its connected end 17*b* will be biased against the ridges 43*d* of the bimetal for good electrical connection.

Terminal 16 has an upwardly biased portion 16*a* with a bump 16*b* formed in it so that when its terminal end is inserted through the hole in the base, such bump 16*b* will press against the lower span of terminal strap 48 for a good electrical connection with the heater coil.

While an operating lever 41 of the rocker type has been shown in FIG. 1, it will be apparent that other types such as paddle lever, toggle lever, or the like may be alternatively snap-in mounted on actuator 24.

The switch is shown in its alternate position in FIG. 1. This position may be an indicator position or the like when double-throw contacts are used or contact terminals 12*a* may be omitted to provide a single throw switch wherein this is the off position. When the switch is actuated from the position shown in FIG. 1 and in broken lines also in FIG. 2 to the "on" position shown in FIG. 2, skirt 38 of the actuator shifts down directly above or into abutment with the bimetal element. While the operating lever is not shown in FIG. 2, it will be appreciated that it would normally have an operating lever as in FIG. 1. In the position shown in FIG. 2, the load to which the switch is connected would be energized. The switch can be normally turned on manually as aforesaid and can normally also be turned off manually by its rocker button. Terminals 16 and 17 are normally connected through a remote switch to a power supply separate from the source supplying the energy through the switch contacts to the load. Such separate power may be adjusted as to its magnitude so as to adjust the time delay between closure of the remote switch and actuation of the switch to its off or alternate position.

If it is desired to turn the switch to its alternate position from a remote point, the remote switch is closed to energize heater coil 46. This coil heats the bimetal along with the current flowing in the bimetal and the bimetal deflects upwardly in FIG. 2, engaging skirt 38 and pushing it up to pivot actuator 24 to its off or alternate position shown in FIG. 1.

While the apparatus hereinbefore described is effectively adapted to fulfill the objects stated, it is to be understood that the invention is not intended to be confined to the particular preferred embodiment of remote control electro-thermal actuator switch disclosed, inasmuch as it is susceptible of various modifications without departing from the scope of the appended claims.

I claim:

1. A remote control electro-thermal actuator switch comprising:

an insulating housing;

switch contacts mounted in said housing;

an actuator mounted in said housing and manually operable to actuate said contacts to a first position energizing a load device and a second position deenergizing said load device;

and electro-thermal means mounted in said housing and controllable from a remote point for moving said manual actuator from said first position to said second position;

said electro-thermal means comprising a bimetal device mounted in said housing and in engagement with said manual actuator when the latter is in said first position;

and a pair of terminals extending from said housing for connecting said bimetal device to a control means at a remote point;

said bimetal device comprising:

an elongated bimetal element mounted in said housing;

a heater coil in heat conduction relation to said bimetal element;

means connecting one end of said heater coil to one end portion of said bimetal element;

a pair of terminals adapted to be connected to a remote control current source;

means connecting one of said terminals to the other end of said heater coil;

and means connecting said other terminal to the other end portion of said bimetal element so that current coming to said terminals flows through both said heater coil and said bimetal element.

2. The remote control electro-thermal actuator switch claimed in claim 1, wherein:

said heater coil surrounds a portion of said bimetal element with an electrically insulator therebetween.

3. The remote control electro-thermal actuator switch claimed in claim 2, wherein:

said means connecting one of said terminals to the other end of said heater coil comprises a terminal strap squeezed around said electrical insulator and the wire at said other end of said heater coil being wrapped around said terminal strap.

4. The remote control electro-thermal actuator switch claimed in claim 3, wherein:

said insulator is a tape with adhesive backing to facilitate application thereof around a portion of said bimetal element.

* * * * *